US010586643B2

(12) United States Patent
Sakai et al.

(10) Patent No.: US 10,586,643 B2
(45) Date of Patent: Mar. 10, 2020

(54) INDUCTANCE ELEMENT RESIN CASE AND INDUCTANCE ELEMENT

(71) Applicant: NTN CORPORATION, Osaka (JP)

(72) Inventors: Kayo Sakai, Mie (JP); Eiichirou Shimazu, Mie (JP); Takayuki Oda, Aichi (JP)

(73) Assignee: NTN CORPORATION, Osaka (JP)

( * ) Notice: Subject to any disclaimer, the term of this patent is extended or adjusted under 35 U.S.C. 154(b) by 224 days.

(21) Appl. No.: 15/554,422

(22) PCT Filed: Feb. 24, 2016

(86) PCT No.: PCT/JP2016/055326
§ 371 (c)(1),
(2) Date: Aug. 29, 2017

(87) PCT Pub. No.: WO2016/140114
PCT Pub. Date: Sep. 9, 2016

(65) Prior Publication Data
US 2018/0047492 A1 Feb. 15, 2018

(30) Foreign Application Priority Data
Mar. 4, 2015 (JP) ..... 2015-042913

(51) Int. Cl.
*H01F 27/02* (2006.01)
*H01F 27/24* (2006.01)

(52) U.S. Cl.
CPC ..... *H01F 27/02* (2013.01); *H01F 27/24* (2013.01)

(58) Field of Classification Search
CPC ..... H01F 27/00–36
(Continued)

(56) References Cited

U.S. PATENT DOCUMENTS

2012/0098631 A1* 4/2012 Ono ..... H01F 3/14 336/96
2013/0314964 A1* 11/2013 Yoshikawa ..... H01F 37/00 363/131
2015/0035636 A1* 2/2015 Nakatsu ..... H01F 27/263 336/192

FOREIGN PATENT DOCUMENTS

CN 102208256 A 10/2011
CN 102568813 A 7/2012
(Continued)

OTHER PUBLICATIONS

International Search Report for PCT/JP2016/055326 dated Mar. 22, 2016.

(Continued)

*Primary Examiner* — Tuyen T Nguyen
(74) *Attorney, Agent, or Firm* — Hedman & Costigan, P.C.; James V. Costigan; Kathleen A. Costigan

(57) ABSTRACT

The present invention facilitates positioning of contact surfaces of a resin case, core gap management, and assembling processing. A resin case 1 can house at least one magnetic core selected from a U-shaped magnetic core, a UU-shaped magnetic core, a UR-shaped magnetic core, and an I-shaped magnetic core. The resin case 1 is used for an inductance element in which a coil is arranged around the magnetic core so as to house the magnetic core. The resin case is an assembly of a plurality of divided members with the same shape. A recess and a projection A1, A2 mutually fitted complementary to each other are formed on end surfaces of the divided members contacted with each other.

8 Claims, 11 Drawing Sheets

(58) Field of Classification Search
USPC ..... 336/65, 83, 90, 92, 96, 200, 220–223
See application file for complete search history.

(56) References Cited

FOREIGN PATENT DOCUMENTS

| | | | | | | |
|---|---|---|---|---|---|---|
| CN | 204155743 | U | | 2/2015 | | |
| JP | 2002-025831 | A | | 1/2002 | | |
| JP | 2006-202922 | A | | 8/2006 | | |
| JP | 2010-027692 | A | | 2/2010 | | |
| JP | 2011-082412 | A | | 4/2011 | | |
| JP | 2013140827 | A | * | 7/2013 | ..... | H01F 37/00 |
| JP | 2014-027088 | A | | 2/2014 | | |
| JP | 2014-078614 | A | | 5/2014 | | |
| WO | WO-2013001593 | A1 | * | 1/2013 | ..... | H01F 37/00 |

OTHER PUBLICATIONS

English Abstract for JP 2006-202922 A dated Aug. 3, 2006.
English Abstract for JP 2010-027692 A dated Feb. 4, 2010.
English Abstract for JP 2002-025831 A dated Jan. 25, 2002.
English Abstract for JP 2011-082412 A dated Apr. 21, 2011.
English Abstract for JP 2014-027088 A dated Feb. 6, 2014.
English Abstract for JP 2014-078614 A dated May 1, 2014.
English Abstract for CN 102208256 A dated Oct. 5, 2011.
English Machine Translation of Abstract for CN 102568813 A dated Jul. 11, 2012.
English Machine Translation of Abstract for CN 204155743 U dated Feb. 11, 2015.

* cited by examiner

INDUCTANCE ELEMENT RESIN CASE AND INDUCTANCE ELEMENT

TECHNICAL FIELD

The present invention relates to an inductance element resin case and an inductance element housed in the inductance element resin case.

BACKGROUND ART

In recent years, along with the progress of miniaturization, increase of frequency and increase of electric current of an electric device and an electronic device, an inductance element is required to be dealt with similarly. However, in the current mainstream ferrite materials among a magnetic core which forms the inductance element, the material properties themselves are approaching the limit, and thus a new magnetic core material is being required. For example, ferrite materials are replaced with new materials such as Sendust and amorphous foil strip, however the replacement is adopted only in a part of the materials. An amorphous powder material having excellent magnetic properties is now known, however forming performance of the amorphous powder material is inferior compared to the conventional materials, and therefore the amorphous powder material is not used widely.

FIGS. 10(*a*) and 10(*b*) illustrate a conventional inductance element provided with at least two U-shaped magnetic cores or UU-shaped magnetic cores, and a coil wound around at least one portion of the magnetic cores. FIGS. 10(*a*) and 10(*b*) illustrate the inductance element provided with a UU-shaped core with a coil, and FIG. 10(*a*) is a plane view and FIG. 10(*b*) is an A-A cross-sectional view.

In an inductance element 13 shown in FIGS. 10(*a*) and 10(*b*), leg parts 15 of UU-shaped magnetic cores 14 are abutted to each other, and the magnetic cores 14 are housed in a resin case 16. Further, coils 17 are arranged at two portions of the leg parts 15. The resin case 16 is obtained by mutually fixing contact surfaces of an upper side upper face 16*a*, an upper side rear face 16*b*, a lower side upper face 16*c* and a lower side rear face 16*d* in the plane view formed separately as four members. Further, the coil 17 is usually assembled as a core member wound in advance when the core is fixed. FIGS. 11(*a*) to 11(*c*) illustrate a U-shaped magnetic core resin case, and FIG. 11(*a*) is a plane view, FIG. 11(*b*) is a front view and FIG. 11(*c*) is a rear view. A resin case 16' is provided with an upper part 16'*a* and a rear face 16'*b* in the plane view.

In a normal U-shaped magnetic core in which soft magnetic plates such as amorphous foil strips are laminated, peripheries of cores are bound by a metal band or the like. However, when the coil member described above is assembled at the same time, binding processing using the band is apt to be complicated, and therefore automation of the binding processing is difficult. Further, when a dust magnetic core formed from magnetic powder material is fixed by the metal band, high radial crushing strength and a lower rattler value are required, and therefore application of this method is limited. Further, even if the dust magnetic core is not fixed by the metal band or the like, a jig for holding the U-shaped magnetic cores to be fixed by an adhesive while positioning the U-shaped magnetic cores is necessary, and therefore assembling processing becomes complicated.

As a reactor using divided magnetic cores, a reactor provided with lamination cores arranged in a square shape, a coil wound around the lamination core which forms a side surface and is arranged to be perpendicular to each outer lamination core via an insulation spacer for forming a gap, and a bobbin with an insulating cylindrical shape in which the lamination core forming the side surface is arranged, is known (see Patent Document 1). In the reactor, the lamination core arranged in the bobbin is divided into two cores in an axial direction, and a partition wall for forming a gap between divided cores is formed integrally with an inner wall part of the bobbin. Further, a reactor provided with a core unit formed by continuously arranging first cores with at least one gap, each of the first cores has a plurality of magnetic properties; a reactor core with a substantially ring shape in a plane view formed by arranging two core units to face each other and arranging second cores having a magnetic property between end parts of the two core units so as to face each other with a predetermined gap; and a fixing member which holds and fixes the position of the first cores forming the core unit and the position of the two second cores, the fixing member being fixed to a case via an elastic body, is known (see Patent Document 2).

PRIOR ART DOCUMENTS

Patent Documents

Patent Document 1: JP 2006-202922 A
Patent Document 2: JP 2010-027692 A

SUMMERY OF THE INVENTION

Problems to be Solved by the Invention

However, it is difficult to position the contact surfaces in assembling of the divided resin cases also in the configuration disclosed in each Patent Document, and further management of a core gap is insufficient and therefore the assembling processing becomes more complicated. Further, in a case in which shapes of the divided resin cases are different from each other, molding dies are necessary for respective resin cases.

An object of the present invention is, in order to solve such a problem, to provide an inductance element resin case capable of facilitating positioning of a contact surface of a resin case, management of a core gap in assembling the inductance element and assembling processing in assembling the inductance element and to provide an inductance element housed in the inductance element resin case.

Means for Solving the Problem

An inductance element resin case according to the present invention is used for an inductance element provided with a coil around a magnetic core and formed to house the magnetic core. The inductance element resin case is formed as an assembly of a plurality of divided members. At least two of the divided members are formed mutually in the same shape. Further, end surfaces of the divided members contacted with each other have a recess and a projection complementary to each other, respectively. Especially, the divided members are formed such that the recess and the projection complementary to each other are to be mutually fitted. Further, a shape in which the recess and the projection complementary to each other are to be mutually fitted is served to prevent drop-off after the fitting of the recess and the projection.

The inductance element resin case according to the present invention is formed to house at least one magnetic core selected from a U-shaped magnetic core, a UU-shaped magnetic core, a UR-shaped magnetic core and an I-shaped magnetic core. Further, an opening part having a drop-off prevention part for the magnetic core is formed on the inductance element resin case at an end surface in an axial direction of the coil arranged in the inductance element resin case. Further, a through hole or a recess part is formed at a predetermined portion of the inductance element resin case where the magnetic core is not contacted.

An inductance element according to the present invention is formed by arranging a coil around a magnetic core housed in the resin case according to the present invention described above.

Effects of the Invention

The inductance element resin case according to the present invention is formed by the assembly of the divided members into which the resin case is divided, and at least two of the divided members are formed mutually in the same shape, and thereby the number of molding dies can be reduced. Especially, the number of the molding dies can be made one by forming all of the divided members in the same shape.

Further, since the recess and the projection complementary to each other are formed at the end surfaces of the divided members contacted with each other, the recess and the projection can be used as a guide for positioning. As a result, the assembling can be performed easily, and especially in a case in which a compressed magnetic core formed from magnetic powder material is utilized, the compressed magnetic core can be easily adopted regardless of the mechanical properties such as strength of the core.

Further, the drop-off function is added to the recess and the projection, and this configuration facilitates handling of the inductance element resin case in carrying.

The recess and the projection formed at the end surfaces contacted with each other are formed to be fitted with each other when the recess and the projection face each other and thereby two insulation cases housing one U-shaped magnetic core can be formed in the same shape, and therefore assembling performance can be improved. Further, since the number of the molding dies can be made one, productivity can be enhanced and a cost can be reduced. Further, the opening part is formed at a part of the insulation case to contact the core and a cooling case with each other, and thereby active cooling can be expected. The inductor can be positioned at a correct position by forming the recess part on the case. The inductor can be positioned at a correct position or the inductor can be fastened together with a cooling lid by forming the through hole on the case.

Other than the combination of two U-shaped magnetic cores, a combination of the U-shaped magnetic core and an I-shaped magnetic core, two UR-shaped magnetic cores, the UR-shaped magnetic core and the I-shaped magnetic core, or an E-shaped magnetic core and the I-shaped magnetic core may be adopted.

MODE FOR CARRYING OUT THE INVENTION

Figure 1:
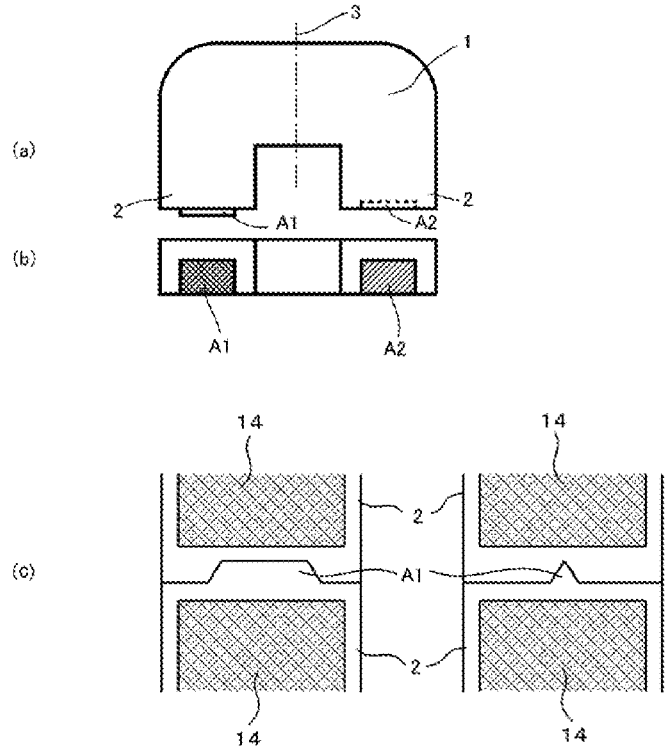
FIGS. 1(*a*) to 1(*c*) are views of a resin case which houses a U-shaped magnetic core.

A resin case according to the present invention relates to a resin case for housing a magnetic core of an inductance element provided with a coil around the magnetic core. FIGS. 1(*a*) to 1(*c*) illustrate one of divided members in a configuration in which a U-shaped magnetic core is used as a magnetic core as an example. FIG. 1(*a*) is an upper part plane view in a plane view of a magnetic core resin case divided into four members. FIG. 1(*b*) is a front view. FIG. 1(*c*) is a cross-sectional view illustrating other examples (two examples) of a recess and a projection complementary to each other. A magnetic core with a ring shape in the plane view is formed by abutting U-shaped leg parts of the U-shaped magnetic cores housed in the resin case to each other. FIG. 1(*a*) and FIG. 1(*b*) illustrate one aspect of the resin case divided into four members. The U-shaped magnetic core resin 1 is an example in which a gap between the U-shaped magnetic cores is large enough to arrange the recess and the projection.

In the resin case 1 shown in FIG. 1(*a*) and FIG. 1(*b*), a projection A1 projected from a contact surface is formed on one surface among the contact surfaces of the leg parts 2 in an axial direction of the coil arranged at a periphery of the resin case, and a recess A2 recessed from a contact surface is formed on another surface. The recess and the projection are arranged to be fitted with the recess and the projection of another resin case 1 when another resin case 1 is rotated to face the resin case 1. That is, in the plane view of the resin case 1, the recess and the projection are formed linear symmetrically with respect to a center line 3 so as to be mutually fitted in assembling. A case which can house the magnetic core with the ring shape in the plane view is formed by assembling four resin cases 1 with the same shape. The case is divided into four members in a thickness direction of the magnetic core and in the axial direction of the coil, and FIG. 1(*a*) and FIG. 1(*b*) illustrate one of the four members.

Further, two shapes shown by the cross-sectional view in FIG. 1(*c*) are other examples of the recess and the projection complementary to each other different from that in FIG. 1(*a*). In these examples, a sectional shape of the leg part of the magnetic core in either of the thickness direction or the axial direction may be formed to be the shape illustrated in the figures, and therefore the sectional shape in the thickness direction and the sectional shape in the axial direction may be formed in the same shape or may be in the difference shapes to be combined with each other.

Figure 2:
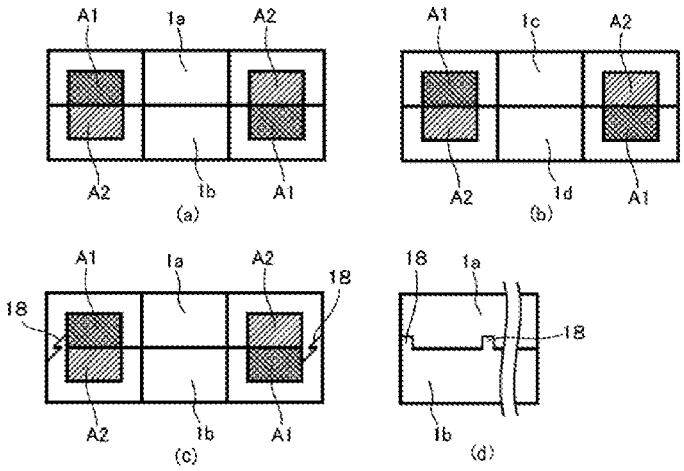
FIGS. 2(*a*) to 2(*d*) are views for explaining a combination method of the resin case.

A combination method of the resin case 1 is described with reference to FIGS. 2(*a*) to 2(*c*). FIGS. 2(*a*) to 2(*c*) are front views of the combined resin case. FIG. 2(*a*) illustrates one U-shaped core, and FIG. 2(*b*) illustrates another U-shaped core. Further, FIG. 2(*c*) illustrates a configuration in which an engagement claw is added to a configuration shown in FIG. 2(*a*), and FIG. 2(*d*) illustrates a side view thereof.

As shown in FIG. 2(*a*), as the resin case 1 having the recess and the projection at the leg parts, a case 1*a* and a case 1*b* are prepared, and the magnetic core formed in a predetermined U-shape is housed in the case 1*a* and the case 1*b*. When the case 1*a* and the case 1*b* having the same shape as the resin case 1 are superimposed, a projection A1 of the case 1*a* and a recess A2 of the case 1*b* are arranged adjacent to each other, and a recess A2 of the case 1*a* and a projection A1 of the case 1*b* are arranged adjacent to each other.

Further, as shown in FIG. 2(*c*) and FIG. 2(*d*), the engagement claws 18 complementary to each other for preventing the drop-off may be formed in at least two portions in the thickness direction to integrate the case 1*a* and the case 1*b*. A recess and a projection of the engagement claw 18 are formed at a position to be fitted with those of another resin case when another resin case is rotated to face the resin case.

As shown in FIG. 2(*b*), a case 1*c* and a case 1*d* are prepared, and the resin cases 1 are superimposed similar to the configuration shown in FIG. 2(*a*) described above. The two U-shaped magnetic cores, which house the magnetic cores as obtained in this way, are positioned to face each other in the axial direction of the coil and assembled while the recess of one side is guiding the projection of another side, and thereby the inductance element formed in the ring shape in the plane view can be obtained easily. That is, the case 1*a* shown in FIG. 2(*a*) and the case 1*c* shown in FIG. 2(*b*) are assembled such that the projection A1 of the case 1*a* and the recess A2 of the case 1*c* are fitted with each other. As a result, the recess A2 of the case 1*a* shown in FIG. 2(*a*) and the projection A1 of the case 1*c* shown in FIG. 2(*b*) are fitted, and the projection A1 of the case 1*b* shown in FIG. 2(*a*) and the recess A2 of the case 1*d* shown in FIG. 2(*b*) are fitted, and the recess A2 of the case 1*b* shown in FIG. 2(*a*) and the projection A1 of the case 1*d* shown in FIG. 2(*b*) are fitted.

Figure 3:
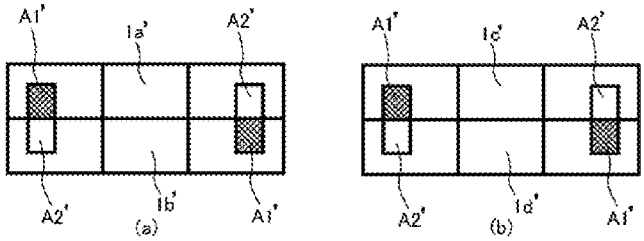
FIGS. 3(*a*) and 3(*b*) are views illustrating an example in which a through hole is formed as a recess.

FIGS. 3(*a*) and 3(*b*) illustrate an example in which a through hole A2' is formed instead of the recess A2. Also in this case, similar to the recess described above, the inductance element with the ring shape in the plane view can be assembled easily by preparing four resin cases. That is, a case 1*a*' shown in FIG. 3(*a*) and a case 1*c*' shown in FIG. 3(*b*) are assembled such that a projection A1' of the case 1*a*' and a through hole A2' of the case 1*c*' are fitted with each other. As a result, a through hole A2' of the case 1*a*' shown in FIG. 3(*a*) and the projection A1' of the case 1*c*' shown in FIG. 3(*b*) are fitted, and a projection A1' of a case 1*b*' shown in FIG. 3(*a*) and a through hole A2' of a case 1*d*' shown in FIG. 3(*b*) are fitted, and a through hole A2' of the case 1*b*' shown in FIG. 3(*a*) and a projection A1' of the case 1*d*' shown in FIG. 3(*b*) are fitted.

In the projection, and the recess or the through hole fitted with each other, it is preferable that a drop-off prevention function after fitting is provided. As the drop-off prevention function after fitting, for example, a complementary recess and projection such as a curve surface and a hook shape may be formed on a vertical surface of the contact surface of a fitting part.

Figure 4:
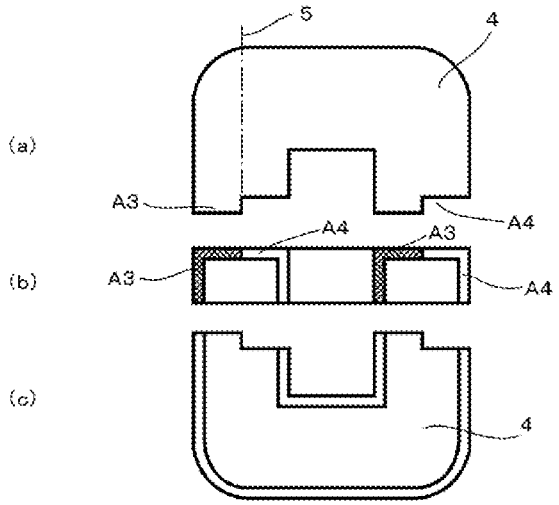
FIGS. 4(*a*) to 4(*c*) are views illustrating an example in which no gap or a slight gap is formed.

FIGS. 4(*a*) to 4(*c*) illustrate an example in which no gap between the contact surfaces of the leg parts 2 is formed or an example in which a distance of the gap is too small to form the recess. FIG. 4(*a*) is a plane view, FIG. 4(*b*) is a front view, and FIG. 4(*c*) is a rear view. In a resin case 4, a projection A3 and a recess A4 are formed at a peripheral part adjacent to the contact surface. It is preferable that a boundary between the recess and the projection is formed near a center line 5 of one leg part in the plane view. Further, it is preferable that a corner of the projection A3 is chamfered in order to prevent the projection A3 from being chipped in assembling. In a case in which a gap exists between the magnetic cores and the leg part of the U-shaped magnetic core is divided and thereby the U-shaped magnetic core can be moved freely in the insulation resin case 4, a resin plate or the like for restricting the movement of the U-shaped magnetic core may be inserted into the gap in order for positioning of the U-shaped magnetic core.

Figure 5:
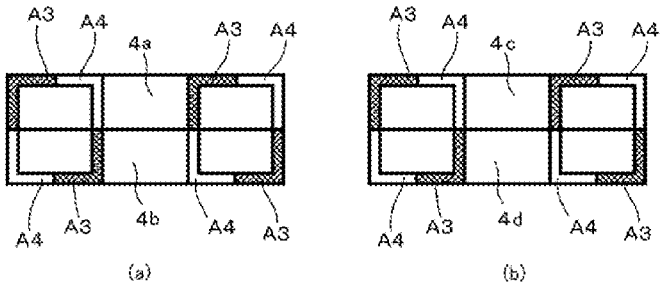
FIGS. 5(*a*) and 5(*b*) are views for explaining a combination method of the resin case in FIG. 4.

A combination method of the resin case 4 is described with reference to FIGS. 5(*a*) and 5(*b*). FIGS. 5(*a*) and 5(*b*) are plane views illustrating the combined resin cases 4. FIG. 5(*a*) illustrates an upper half part of a case in the plane view, and FIG. 5(*b*) illustrates a lower half part of the case in the plane view.

As the resin case 4 having the recess and the projection at the leg parts, a case 4*a* and a case 4*b* are prepared, and a magnetic core formed in a predetermined U-shape is housed in the case 4*a* and the case 4*b*. At this time, the case 4*a* and the case 4*b* formed by the same resin case 4 are superimposed, and as a result of that, a projection A3 of the case 4*a* and a recess A4 of the case 4*b* are located to face each other, and a recess A4 of the case 4*a* and a projection A3 of the case 4*b* are located to face each other.

Similarly, a case 4*c* and a case 4*d* are prepared, and the resin cases 4 are superimposed similarly as described above. The two U-shaped magnetic cores, which house the magnetic cores as obtained in this way, are positioned to face each other in the axial direction of the coil and assembled while the recess of one side is guiding the projection of another side, and thereby the inductance element with the ring shape in the plane view capable of setting the distance of the gap from zero can be obtained easily. That is, the case 4*a* shown in FIG. 5(*a*) and the case 4*c* shown in FIG. 5(*b*) are assembled such that a projection A3 of the case 4*a* and a recess A4 of the case 4*c* are fitted with each other. As a result, a recess A4 of the case 4*a* shown in FIG. 5(*a*) and a projection A3 of the case 4*c* shown in FIG. 5(*b*) are fitted, and a projection A3 of the case 4*b* shown in FIG. 5(*a*) and a recess A4 of the case 4*d* shown in FIG. 5(*b*) are fitted, a the recess A4 of the case 4*b* shown in FIG. 5(*a*) and a projection A3 of the case 4*d* shown in FIG. 5(*b*) are fitted.

The combination methods shown in FIGS. 2(*a*) to 2(*c*), FIGS. 3(*a*) and 3(*b*), and FIGS. 5(*a*) and 5(*b*) described above are provided by preparing four resin cases having the same shape capable of housing the U-shaped magnetic core and by assembling the four resin cases so that the inductance element with the ring shape in the plane view is obtained. However, also in a combination of the U-shaped magnetic core and an I-shaped magnetic core, the number of the molding dies for a case of the I-shaped magnetic core can be made one by forming the recess and the projection similarly as described above on surfaces of the I-shaped magnetic core and the U-shaped magnetic core contacted with each other.

Figure 6:
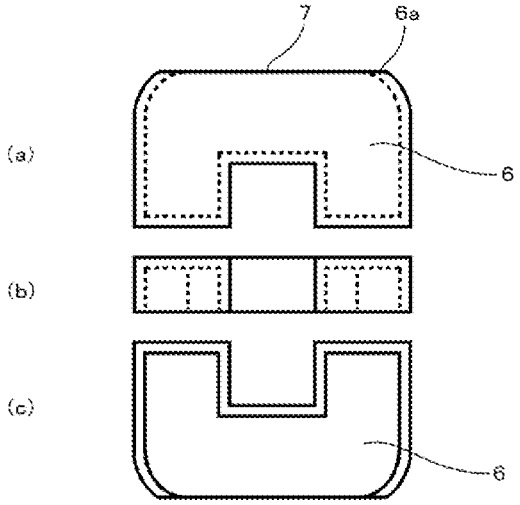
FIGS. 6(*a*) to 6(*c*) are views illustrating an example in which an opening part is formed on the resin case.

In the resin cases shown in FIGS. 1(*a*) to 1(*c*) and FIGS. 4(*a*) to 4(*c*), an opening part for active cooling of the magnetic core may be formed in order to expose a part of the magnetic core housed in the resin case. FIGS. 6(*a*) to 6(*c*) illustrate an example in which the opening part is formed. FIGS. 6(*a*) to 6(*c*) illustrate the example in which the opening part for cooling is formed in the resin case shown in FIGS. 1(*a*) to 1(*c*). FIG. 6(*a*) is a plane view, FIG. 6(*b*) is a front view, and FIG. 6(*c*) is a rear view. Here, an illustration of the recess and the projection is omitted. An opening part 7 is formed at a top part of a resin case 6. At this time, in order to prevent a coil from being dropped off in the axial direction, a part of the case is remained in a direction in which the coil is dropped off, or alternatively a shoulder part 6*a* is formed.

An inductance element is obtained by housing a magnetic core in a resin case and by forming the coil around the magnetic core, and further a shoulder part for positioning of the coil may be formed in the resin case. A configuration in which the shoulder part is formed facilitates assembling of the inductance element.

Figure 7:
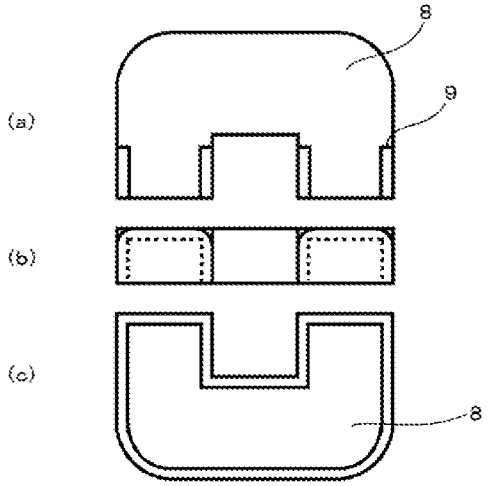
FIGS. 7(*a*) to 7(*c*) are views illustrating an example in which a shoulder part is formed on the resin case.
Figure 8:
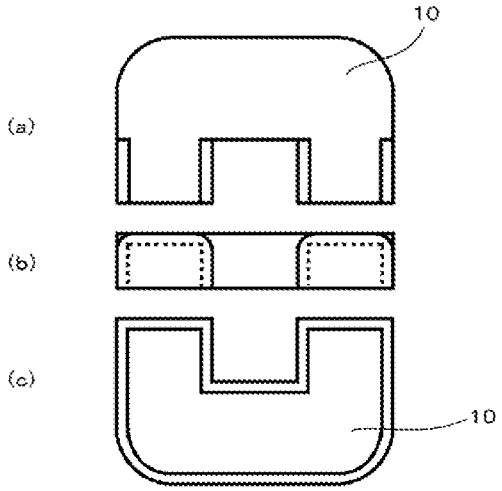
FIGS. 8(*a*) to 8(*c*) are views illustrating an example in which the shoulder part is not formed on the resin case.

FIGS. 7(*a*) to 7(*c*) illustrate an example in which the shoulder part is formed. FIG. 7(*a*) is a plane view, FIG. 7(*b*) is a front view, and FIG. 7(*c*) is a rear view. An illustration of the recess and the projection is omitted. A shoulder part 9 for positioning of the coil may be formed at a peripheral part of a leg part of a resin case 8. Accordingly, a positioning guide for the coil is not necessary on a cooling case or a ground contact surface when the inductance element is assembled. Further, in a case in which a size of the coil is substantially the same as an inner size of the leg part, the shoulder part may not be formed. FIGS. 8(*a*) to 8(*c*) illustrate an example of such a case. FIG. 8(*a*) is a plane view, FIG. 8(*b*) is a front view, and FIG. 8(*c*) is a rear view. An illustration of the recess and the projection of a resin case 10 is omitted.

Figure 9:
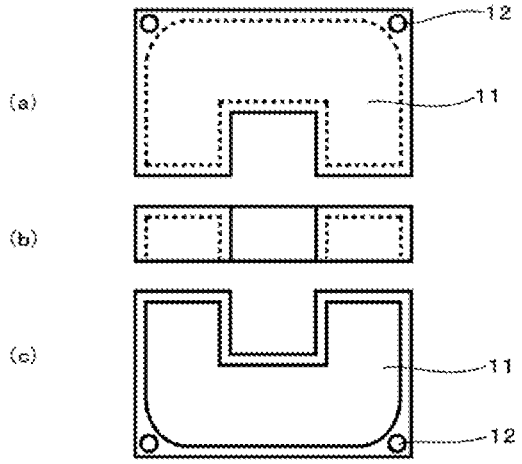
FIGS. 9(*a*) to 9(*c*) are views illustrating an example in which a through hole for positioning is formed on the resin case.
Figure 10:
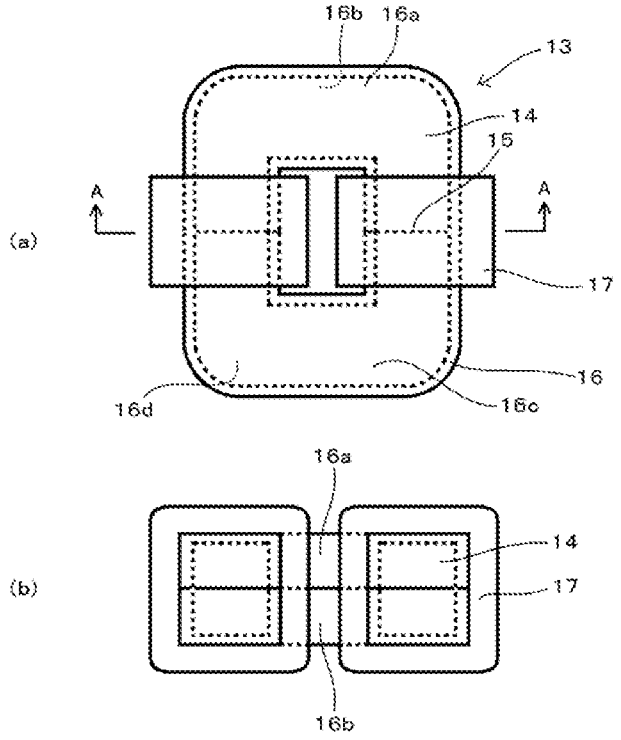
FIGS. 10(*a*) to 10(*b*) are views illustrating an inductance element provided with a UU-shaped magnetic core.
Figure 11:
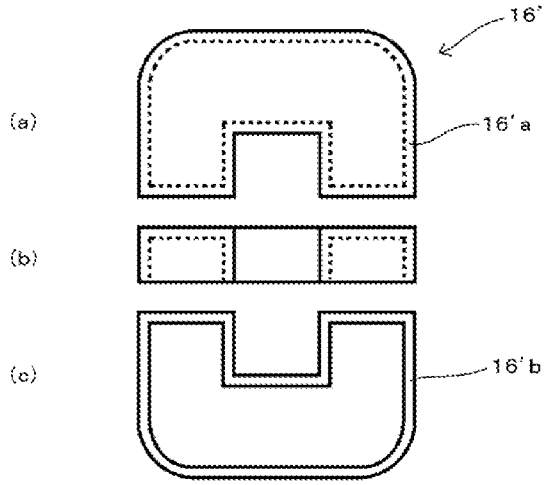
FIGS. 11(*a*) to 11(*c*) are views illustrating a resin case for a U-shaped magnetic core.

FIGS. 9(*a*) to 9(*c*) illustrate an example in which a through hole for positioning of an inductance element is formed. FIG. 9(*a*) is a plane view, FIG. 9(*b*) is a front view, and FIG. 9(*c*) is a rear view. An illustration of the recess and the projection is omitted. A through hole 12 for positioning of the inductance element is formed at a portion of a resin case 11 where a magnetic core, which is housed in the resin case 11, is not contacted, for example, a portion adjacent to an apex angle of a rectangle in the plane view. Here, a recess may be formed instead of the through hole 12. The positioning can be performed by two points at opposite angles. Further, the through holes 12 may be formed at four portions adjacent to the apex angles and the inductance element can be fastened together with a cooling lid or the like while positioning the inductance element. With this, the inductance element can be further actively cooled. In a case in which the inductance element is not fastened together with the cooling lid or the like, a recess may be formed for positioning of the inductance element.

Since the resin case facilitating the positioning is utilized, the inductance element according to the present invention can be applied to the inductance element with a combination of the U-shaped magnetic core and the I-shaped magnetic core, a combination of two UR-shaped magnetic cores, a combination of the UR-shaped magnetic core and the I-shaped magnetic core, or a combination of an E-shaped magnetic core and the I-shaped magnetic core, other than the inductance element with the combination of the two U-shaped magnetic cores. Further, since the function of gap management of the magnetic core and drop-off prevention in carrying is provided, assembling performance of the inductance element is improved. Since the number of the molding dies can be made one, productivity can be enhanced and a cost can be reduced.

INDUSTRIAL APPLICABILITY

The inductance element resin case according to the present invention is capable of facilitating positioning in assembling and a single molding die can be adopted, and thereby the inductance element resin case can be applied to various kinds of inductance elements.

REFERENCE SIGNS LIST

1, 4, 6, 8, 10, 11: resin case
2: leg part
3, 5: center line
7: opening part
9: shoulder part
12: through hole
13: inductance element
14: UU-shaped magnetic core
15: leg part
16: resin case
17: coil
18: engagement claw

The invention claimed is:

1. An inductance element resin case used for an inductance element provided with a coil around a magnetic core and configured to house the magnetic core, the inductance element resin case is an assembly of four members, said inductance element resin case being divided in a thickness direction of the magnetic core and in an axial direction of the coil, each of the members being U-shaped, wherein at least two of the members are formed mutually in the same shape and wherein there are a recess and a projection at leg parts of the U-shaped members, and wherein in the inductance element resin case, two first members and two second members are each superimposed so that the projections of one of said two first members and the recesses of one of said two second members are arranged adjacent to each other in the thickness direction of the magnetic core, and said two first members as superimposed and said two second members as superimposed are combined so that the recess and the projection are fitted with each other in the axial direction of the coil.

2. The inductance element resin case according to claim 1, wherein each of the members has the leg part having an end surface at which the recess is formed and the leg part having an end surface at which the projection is formed, wherein the end surfaces of any one of the members contact the end surfaces of another one of the members.

3. The inductance element resin case according to claim 1, wherein a shape in which the recess and the projection complementary to each other are to be mutually fitted is served to prevent drop-off after the fitting.

4. The inductance element resin case according to claim 1 configured to house at least one magnetic core selected from a U-shaped magnetic core, a UU-shaped magnetic core, and a UR-shaped magnetic core.

5. The inductance element resin case according to claim 1, further comprising an opening part of the inductance element resin case formed at an end surface in an axial direction of the coil arranged in the inductance element resin case, and a drop-off prevention part for the magnetic core housed in the inductance element resin case.

6. The inductance element resin case according to claim 1, further comprising a shoulder part for positioning of the coil at a periphery of the inductance element resin case.

7. The inductance element resin case according to claim 1, further comprising a through hole or a recess part at a portion of the inductance element resin case where the magnetic core is not contacted.

8. An inductance element comprising:

a magnetic core housed in a resin case; and a coil arranged around the magnetic core, wherein the resin case is formed as the inductance element resin case according to claim 1.

* * * * *